US011219289B2

(12) United States Patent
Watt

(10) Patent No.: US 11,219,289 B2
(45) Date of Patent: Jan. 11, 2022

(54) KIT FOR TOWING ITEMS THROUGH WATER WHILE SWIMMING

(71) Applicant: ABOVE BELOW LTD., London (GB)

(72) Inventor: William Dickson Watt, London (GB)

(73) Assignee: Above Below Ltd., London (GB)

( * ) Notice: Subject to any disclaimer, the term of this patent is extended or adjusted under 35 U.S.C. 154(b) by 0 days.

(21) Appl. No.: 17/291,559

(22) PCT Filed: Nov. 5, 2019

(86) PCT No.: PCT/GB2019/053130
§ 371 (c)(1),
(2) Date: May 5, 2021

(87) PCT Pub. No.: WO2020/095037
PCT Pub. Date: May 14, 2020

(65) Prior Publication Data

US 2021/0315341 A1 Oct. 14, 2021

(30) Foreign Application Priority Data

Nov. 5, 2018 (GB) ..... 1818018

(51) Int. Cl.
*A45C 13/38* (2006.01)
*B63B 7/08* (2020.01)
(Continued)

(52) U.S. Cl.
CPC ..... *A45C 11/22* (2013.01); *A45C 13/38* (2013.01); *B63B 7/08* (2013.01); *B63B 34/60* (2020.02);
(Continued)

(58) Field of Classification Search
CPC ..... B63B 25/004; B63B 35/00; B63B 34/05; B63B 34/54; B63B 37/08; B63B 2205/00; A45C 13/38
(Continued)

(56) References Cited

U.S. PATENT DOCUMENTS 4,973,278 A * 11/1990 Williams ..... A47C 15/006 441/131
5,171,178 A * 12/1992 Creek ..... B63B 34/50 441/132
(Continued)

FOREIGN PATENT DOCUMENTS

| | | | |
|---|---|---|---|
| CN | 105105500 | B | 3/2018 |
| CN | 207450199 | U | 6/2018 |
| WO | 2017222388 | A1 | 12/2017 |

OTHER PUBLICATIONS

Search Report and Written Opinion for PCT/GB2019/053130, from which US application derives.
(Continued)

*Primary Examiner* — Justin M Larson
(74) *Attorney, Agent, or Firm* — Insigne PC

(57) ABSTRACT

A kit is for towing through water by a swimmer to transport items, which comprises: an inflatable flotation device and a dry bag (32). The flotation device comprises, when inflated, a lead portion (10*a*), two spaced side portions (10*b*, 10*c*) each extending rearwardly from the lead portion, and attachment means. The dry bag (32), which may be separate to the flotation device, has an openable, water-tight closure. The side portions, when the device is inflated, and the dry bag are respectively shaped to cooperate so that the side portions provide support for the dry bag. The flotation device including the attachment means is arranged to attach the dry bag to the flotation device such that the closure (34) is located above a lead portion of the flotation device. The kit is
(Continued)

attachable to a tow leash (32) such that a swimmer can tow the flotation device with the dry bag attached in water and such that the lead portion leads through the water.

18 Claims, 4 Drawing Sheets

(51) Int. Cl.

| | |
|---|---|
| ***B63B 34/54*** | (2020.01) |
| ***B63B 35/00*** | (2020.01) |
| ***B63B 21/56*** | (2006.01) |
| ***A45C 11/22*** | (2006.01) |
| ***B63B 34/60*** | (2020.01) |
| *B63B 34/00* | (2020.01) |

(52) U.S. Cl.
CPC ..... *B63B 21/56* (2013.01); *B63B 34/05* (2020.02); *B63B 34/54* (2020.02); *B63B 35/00* (2013.01)

(58) Field of Classification Search
USPC ..... 441/132; 220/560
See application file for complete search history.

(56) References Cited

U.S. PATENT DOCUMENTS

| | | | | |
|---|---|---|---|---|
| 5,217,400 | A * | 6/1993 | Creek | B63B 34/50 441/132 |
| D347,873 | S * | 6/1994 | Lohn | D21/803 |
| D362,706 | S * | 9/1995 | Wamsley | D12/306 |
| 5,474,481 | A | 12/1995 | Ramsey | |
| 5,597,277 | A * | 1/1997 | Mayfield | B63B 34/50 441/130 |
| 6,250,983 | B1 * | 6/2001 | Paterson | B63B 17/02 114/344 |
| 6,491,558 | B1 * | 12/2002 | Myers | B63B 34/565 441/130 |
| 6,929,521 | B2 * | 8/2005 | Howerton | A47C 15/006 441/132 |
| 7,178,475 | B2 * | 2/2007 | Hall, Jr. | B63B 7/08 114/242 |
| 7,311,056 | B1 * | 12/2007 | Krogstad | B63B 21/56 114/242 |
| 7,798,879 | B2 * | 9/2010 | James | B63C 9/135 441/118 |
| 8,025,541 | B2 * | 9/2011 | Churchill | B63B 34/52 441/40 |
| 8,215,515 | B2 * | 7/2012 | Churchill | A47G 23/02 220/560 |
| D786,998 | S * | 5/2017 | Frerich | D21/803 |
| D821,521 | S * | 6/2018 | Peterson | D21/803 |
| 2004/0038603 | A1 * | 2/2004 | Gaspar | A47C 15/006 441/130 |
| 2007/0059998 | A1 * | 3/2007 | Zheng | B63B 34/50 441/129 |
| 2010/0252560 | A1 | 10/2010 | Churchill | |
| 2011/0117802 | A1 * | 5/2011 | Bonacci | B63C 11/02 441/129 |
| 2011/0177732 | A1 * | 7/2011 | Clifford | B63C 9/065 441/38 |
| 2015/0250295 | A1 * | 9/2015 | Davis, Jr. | B63B 32/87 224/578 |
| 2019/0159578 | A1 * | 5/2019 | St. Pierre | B63B 34/20 |
| 2019/0233199 | A1 * | 8/2019 | Collie | A45F 3/02 |

OTHER PUBLICATIONS

Search and Examination Report for GB1818018.2, from which priority is claimed.

Chillswim, 2016, "Swim Secure Chillswim Tow Donut—Safer Open Water Swimming High Viz Item Carrier" amazon.co.uk, [online], Available from https://www.amazon.co.uk/Swim-Secure-Chillswim-Tow-Donut/dp/B01JC7UGMS/ref=cts_sp_4_vtp [Accessed Apr. 4, 2019 by UK patent examiner].

Branden Gunem, 2018, "Kokopelli Packraft", facebook.com. [Online] available from https://d.facebook.com/KokopelliPackraft/photos/a.856361857854299.1073741845.171220799701745/1013465905477226/?type=3&_tn_=EH-R [Accessed Apr. 4, 2019 by UK patent examiner].

Jesse Freitas, "Explore Nature with Kokopelli Packraft, Customer Stories from StickerGiant11," Jul. 6, 2016 (Jul. 6, 2016), XP055666419, Retrieved from http://www.stickergiant.com/blog/explore-nature-with-kokopelli-packraft/?c=stickerstories&ag=outdoors&kw=kokopellipackraft [retrieved on Feb. 7, 2020].

* cited by examiner

KIT FOR TOWING ITEMS THROUGH WATER WHILE SWIMMING

CROSS-REFERENCE TO RELATED APPLICATIONS

The present application is being submitted as a national stage application of, and claims priority to, International Application No. PCT/GB2019/053130 filed on May 11, 2019 entitled, "Kit for Towing Items Through Water While Swimming," the entire disclosure of which is incorporated herein by reference.

BACKGROUND OF INVENTION

1. Field of Invention

The invention relates to a modular kit for dragging through water by a swimmer to transport items. The method also relates to a method of assembling the modular kit.

2. Background

Swimmers may want to transport items over open water. Flotation means is known for transporting small items, such as money, a phone or a wallet. The flotation means has three compartments. Two of the compartments each have a respective valve enabling inflation and deflation. Items can be located in a third compartment through a sealable opening. A tow leash is attached to the flotation means at one end thereof and extends around a swimmer's waist at the other end. However, the flotation means does not have the capacity to enable larger items, such as a hiking rucksack capable of containing, for example, 40 litres of items, to be transported.

A compartment that is so large as to accommodate such a hiking rucksack requires more material than the prior art flotation means. Additionally, such a compartment, which can accommodate greater mass of items, requires a larger associated inflated volume to ensure flotation. One or more inflatable compartments providing such volume also require more material. A problem is that the amount of material required to enable transportation of a greater volume and mass of items means that the resultant flotation means cannot easily be transported due to both weight and volume. For example, it would be convenient to be able to carry a flotation means in a hiking rucksack alongside other items such as a tent, which could all then be transported in water using the flotation means, but this is not currently possible.

An object of the present invention is to provide a flotation means that allows transportation of larger and/or heavier items in water, and is formed of sufficiently little material as to be easily portable.

SUMMARY OF THE INVENTION

In accordance with a first aspect of the present invention, there is provided a kit for towing through water by a swimmer to transport items, comprising: an inflatable flotation device comprising an inflatable lead portion, two inflatable spaced side portions and attachment means, wherein the side portions each extend rearwardly from the lead portion; and a dry bag separate to the flotation device and having an openable, water-tight closure, wherein the side portions, when the device is inflated, and the dry bag are respectively shaped to cooperate so that the side portions provide support for the dry bag, wherein the kit is attachable to a tow leash such that a swimmer can tow the flotation device with the dry bag attached in water and such that the lead portion leads through the water, wherein the kit has mass of less than 1.2 kgs, and wherein a volume that the dry bag is able to contain is at least 70 litres. Preferably the flotation device including the attachment means is arranged to attach the dry bag to the flotation device such that the closure is located above the lead portion of the flotation device, The spaced inflated side portions provide support for the dry bag without significant need for material between them, which enables weight and volume of the material of the flotation device to be reduced. The closure of the dry bag being located over the lead portion advantageously results in the mass of the dry bag with its contents being distributed such that the amount of air required for flotation is minimised or reduced, which means that the amount of material required to form inflatable compartments is reduced. The closure of the dry bag being over the lead portion also means that the mass of the dry bag with its contents is typically distributed on the flotation device such that the flotation device may tilt in water with lead end of the flotation device being higher than a rear part of the side portions. This prevents the lead end being dragged under water during towing and reduced water resistance. The flotation device is preferably also arranged such that the lead portion provides greater inflated volume at the lead end of the flotation device than is present at the rear, which also contributes to the tilt and prevents the lead end being dragged under water.

The flotation device preferably tapers rearwardly from the lead portion at a periphery thereof, for reduced resistance to towing.

The side portions may be spaced and the lead portion may be shaped such that the dry bag tilts downwardly into the space in use. In some embodiments, a bag of the dry bag may extend below the water level, which assists with flotation.

The attachment means may be arranged to secure the dry bag against the flotation device on a top portion thereof with the closure over the lead portion.

The attachment means may comprise a plurality of straps. A respective length of one, some or all of the straps may be adjustable.

One or two straps may be configured to extend between the side portions diagonally with respect to a length of the flotation device.

A further of the straps may be configured to extend along a length of the dry bag and may be attached at one end thereof to the lead portion.

The kit may further comprise a non-inflatable support means extending between the two side portions. The other end of the further strap may be secured to the support means.

The kit may further comprise the tow leash attached to the lead portion or to the dry bag.

The kit may have a mass of less than 1.2 kgs. The volume of the dry bag may be at least 30 litres, preferably greater than 70 litres, preferably still more than 80 liters.

The closure of the dry bag may open to have a circumference of at least 60 cm.

The flotation device may enable floating of items within the dry bag at least 10 kgs, preferably at least 14 kgs. This is typically more than the mass of a rucksack of 70 litres, which is typically used for a full 3 day expedition.

The flotation device may have a marking on the lead portion thereof. In this case the dry bag can be located attached with a closure end over the marking. The marking is located such that the dry bag can be easily attached to the flotation device with a result that the flotation device with the attached dry bag is stable in use in water with the mass distributed in a predetermined manner, which may be as mentioned above. This also allows the inflated volume to be minimised, or at least reduced.

At a rear portion of the inflatable flotation device, the side portions may be spaced without any inflated portion being located between them.

There may be provided an assembly comprising the dry bag attached to the inflated flotation device, with the tow leash attached to the flotation device.

According to a second aspect of the present invention, there is provided a method comprising: inflating a flotation device, the flotation device comprising attachment means, an inflatable lead end and two inflatable, spaced side portions extending rearwardly from the lead portion, wherein the inflating the flotation device comprises inflating the lead end and the two spaced side portions; locating at least one item in a dry bag having an openable, water-tight closure, the dry bag being separate to the flotation device, attaching the dry bag to the flotation device using the attachment means such that the closure is located above a lead portion thereof in use, wherein the kit has mass of less than 1.2 kgs, wherein a volume that the dry bag is able to contain is at least 70 litres, wherein the kit is attachable to a tow leash such that a swimmer can tow the flotation device with the dry bag attached in water.

The attaching of the dry bag may comprise attaching the dry bag such that a closure end of the dry bag is located where indicated by a marking on the lead end. This results in good distribution of mass of the dry bag and its contents.

The flotation device may further comprise a support means located between the side portions.

The flotation device may further comprise a non-inflatable support means, for example a strap or a webbing, extending between the two side portions. This support means constrains distance between the side portions, preventing deformation of the flotation device. Further, in some embodiments this support means may support the dry bag by direct contact with the dry bag.

The method of the second aspect be in use of the kit of the first aspect.

BRIEF DESCRIPTION OF THE DRAWINGS

For better understanding of the present invention, embodiments will now be described with reference to the accompanying drawings in which.

DETAILED DESCRIPTION OF EMBODIMENTS

Certain terminology is used in the following whose meaning depends on orientation of a flotation device. In use in water, the flotation device has a predetermined lower side and upper side. The flotation device is also pulled such that a predetermined lead portion leads through water when the flotation device is dragged. The terms "upper", "lower", "rear" and "side", as well as other terms dependent on orientation of the flotation device, should be construed accordingly.

Figure 1:
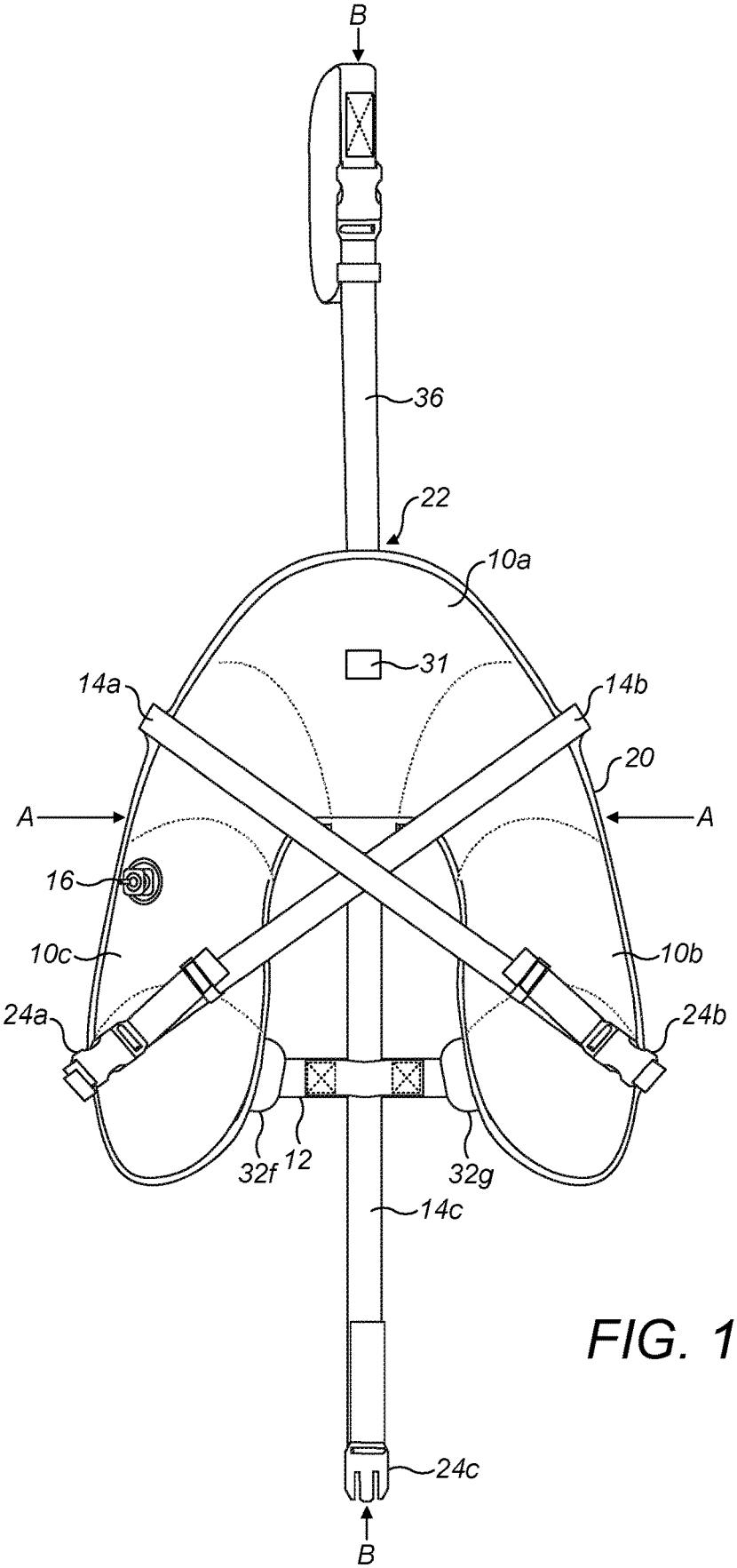
FIG. 1 is a plan view of a flotation device of a kit in accordance with embodiments.
Figure 2:
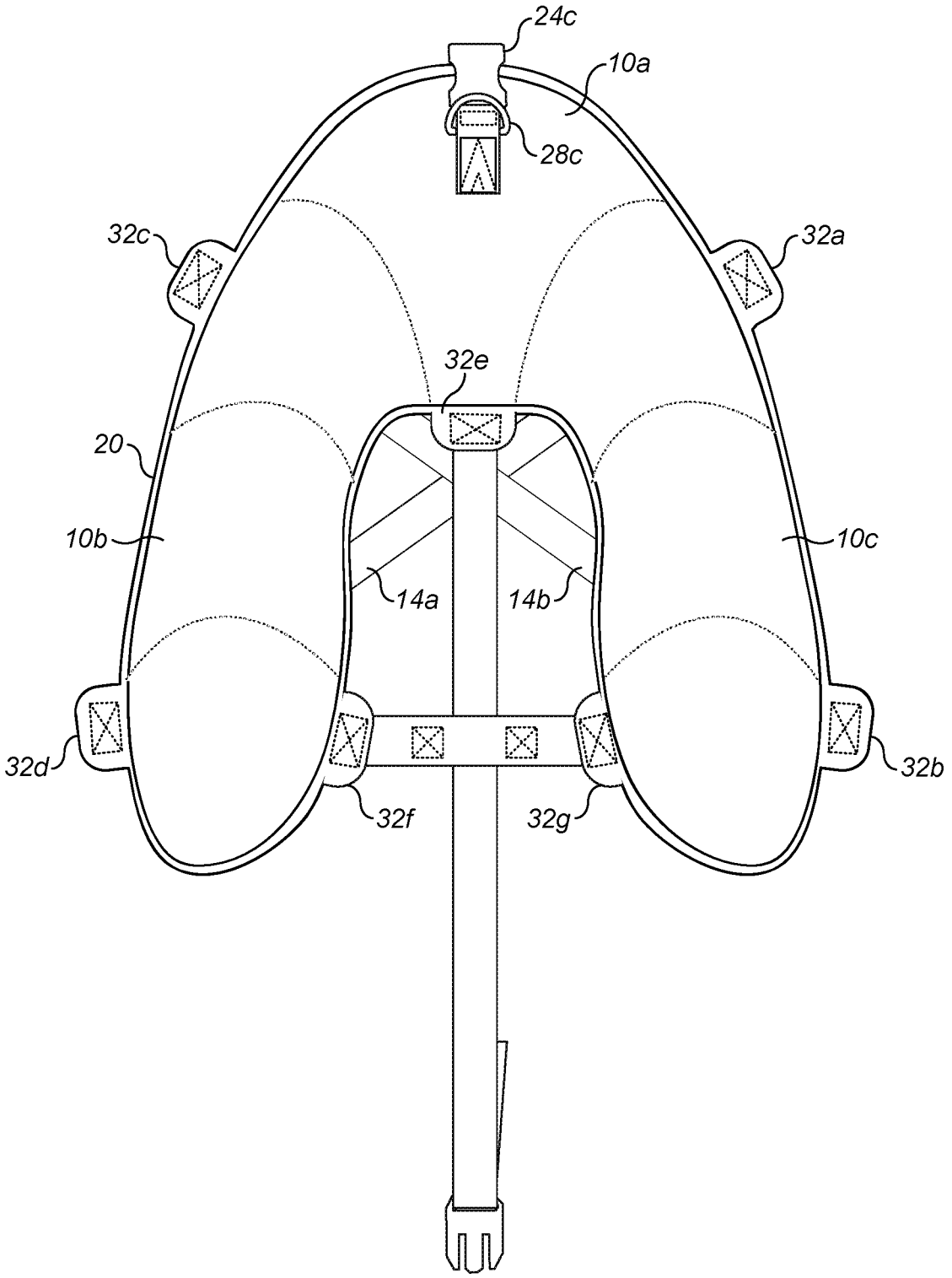
FIG. 2 is a plan view of an underside view of the flotation device.

A kit in accordance with embodiments comprises a flotation device, a flexible dry bag and a tow leash. Referring to FIGS. 1 and 2, the flotation device comprises a float, a support strap 12 and flexible bag attachment straps 14*a-c*.

The float is formed of a single inflation chamber having a lead portion 10*a* and first and second spaced side portions 10*b*, 10*c* extending rearwardly from the lead portion 10*a*. The lead portion 10*a* and the first and second side portions 10*b*, 10*c* together provide a U-shaped space. In FIG. 1 the side portions 10*b*, 10*c* are shown below of line A-A, whereas the lead portion 10*a* is shown above this line.

The float 10*a-c* has an inflation valve 16 by which the inflation chamber can be inflated and deflated. In variant embodiments, the float may include one or more dividing walls resulting in more than one inflation chamber, in which case each inflation chamber has a respective inflation valve.

The float 10*a-c* has a circumferential flange portion 20 extending around the float 10*a-c* in a plane. The float 10*a-c* is formed of two pieces of plastics material bonded together at the flange portion 20. The flange portion 20 extends around the inside of the U-shaped space, as well as around an outer periphery of the float 10*a-c*.

The support strap 12 extends between the first and second side portions 10*b*, 10*c* across the U-shaped space. Ends of the support strap 12 are attached to the flange portion 20, one end to the first side portion 10*b* and the other end to the second side portion 10*c*. In a variant embodiment, in place of the support strap 12, a webbing extends between the first and second side portions 10*b*, 10*c*, attached to the flange portion 20 in the U-shape space along the first and second side portions 10*b*, 10*c*. The support strap or webbing preferably does not form a water impermeable base to the flotation device.

A "length" of the flotation device is from a nose 22 of the lead portion 10*a* to the rear of the float, as indicated by line B-B. A first of the flexible straps 14*a* is attached to the flange portion 20 at an outer of the first side portion 10*b* and extends across the float, including across the U-shaped space, to attach to flange portion 20, such that the strap 14*a* extends diagonally with respect to the length of the flotation device. Similarly, a second of the flexible straps 14*a* is attached at the flange portion 20 at the outer periphery of the second side portion 10*c* and extends across the float, including across the U-shaped space, to attach to flange portion 20, such that the strap 14*b* extends diagonally with respect to the length of the flotation device.

The first and second flexible straps 14*a*, 14*b* each have a buckle 24*a*, 24*b* enabling the length of the respective strap to be changed and for the strap to be done up and undone. Thus each strap can be done up and tightened after the dry bag is located on an upper portion of the float. The first and second straps 14*a*, 14*b* are arranged so that mass of the dry bag 30 is substantially evenly balanced over the first and second side portions 10*b*, 10*c*. This facilitates towing in a straight line.

A third of the straps 14*c* is secured at one end to the flange material 20 extending from the lead portion 10*a*, at the U-shaped space. The third strap 14*c* extends through an aperture in the support strap 12 and then over a top of the float to attach to a securing portion 26 on an underside surface of the lead portion 10*a* of the float. The third strap 14*c* also has a buckle 24*c* enabling the length to be changed and for the strap to be done up and undone. The securing portion 26 is attached to the material of the float 10*c* by means of stitching and adhesive, such that the securing portion 26 is sufficiently well secured to the float 10*c* so that the strap 14*c* can be tightened and to allow dragging by a tow leash attached to the securing portion 26, without the sealing of the float being compromised.

Where the straps 14*a-c* are attached to the flange material 20, the flange material 20 includes tabs 32*a-e*. Preferably the tabs 32*a-e* are formed of the same piece of material as at least one of the upper and lower pieces of material from which the float 10*a-c* and the flange portions 20 are formed. Preferably still, for additional strength, the tabs 32*a-e* are formed of both the upper and lower pieces, bonded together. Ends of the straps 14*a*, 14*b* are each attached to a respective one of the tabs 32*a-d*. An end of the strap 14*c* is attached to the tab 32*e*. Also, tabs 32*f*, 32*g* are provided for attachment of the support strap 12 to the side portions 10*b*, 10*c*. The ends of the straps 14*a-c*, 12 may be attached to the tab portions 32*a-g* by stitching. Attachment methods other than stitching may be alternatively used.

The dry bag, indicated at 30, is formed of flexible, impermeable material, for example nylon with an impermeable coating, for example TPU coated nylon. The bag 30 has a roll top closure at a roll top end 34 comprising an upper portion of the bag, a strap and a buckle. The upper portion can be rolled down and the strap used to secure the upper portion in a rolled down position.

Figure 3:
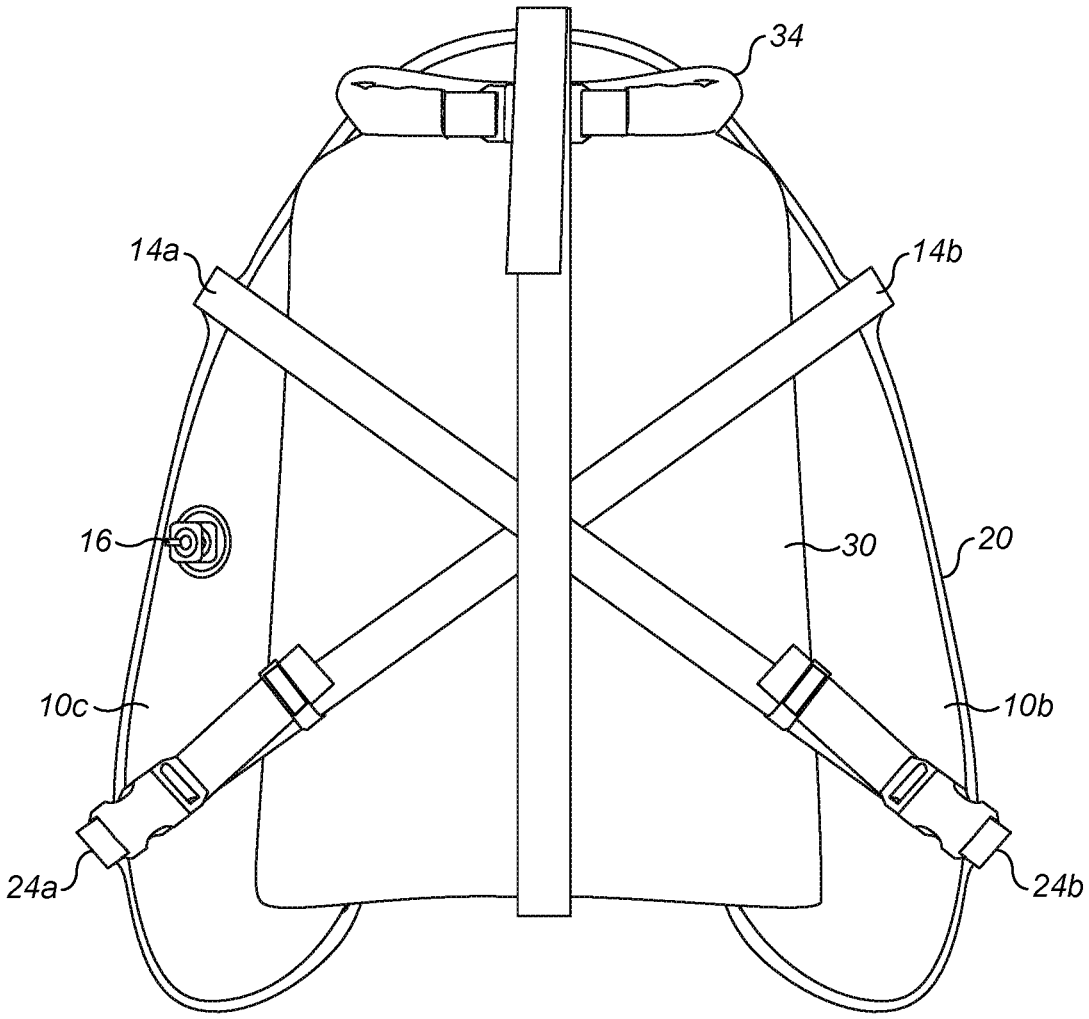
FIG. 3 is a plan view of the flotation device with a dry bag attached.
Figure 4:
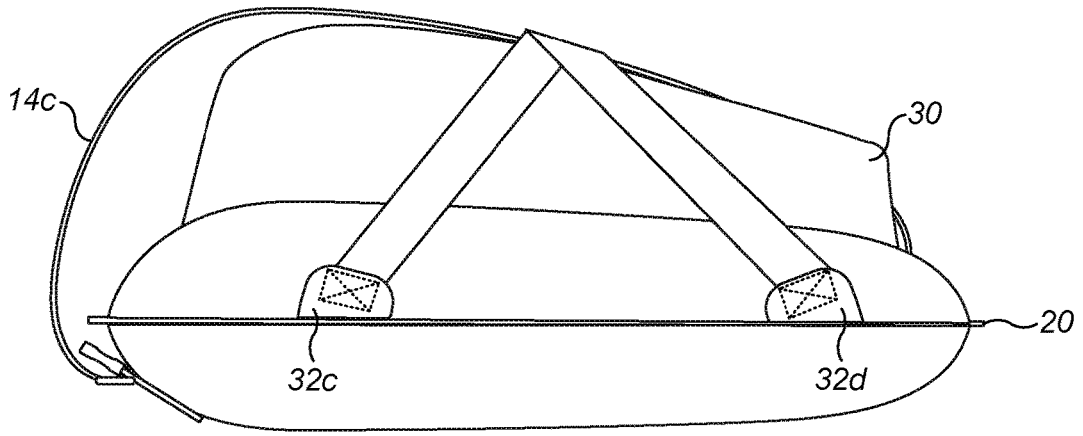
FIG. 4 is a side view of the flotation device with the bag attached.

Referring to FIGS. 3 and 4, the dry bag 30 is shaped and sized relative to the float so that a base end can be partially located in a space between the first and second side portions 10*b*, 10*c*, with the bag 30 leaning against the leading portion 10*a*. Thus, the roll top end is located above the leading portion 10*a*. This results in the roll top end being generally located above water level in use. The side portions and the lead portion may be arranged so as to distribute the dry bag 30 and its contents, in use, such that the float tilts and the lead end 10*a* is located higher than a rear of the side portions 10*b*, 10*c*. The arrangement of the side portions and the lead portion also results in a greater volume of inflated space at the lead end of the flotation device than at the rear, which results in such tilt. The dry bag 30 has a volume of at least 70 litres. The volume is preferably less than 100 litres, preferably less than 90 litres.

The third strap 14*c* can be used to set the position of the dry bag 30 on the flotation device. The lead portion 10*c* of the float has a marking 31 on it. The flotation device is provided with instructions for the user, so that the user locates the dry bag 30 with the roll top end thereof located covering the marking 31 and fixes the third strap 14*c* to keep the dry bag 30 in that position. This results in a distribution of mass of the dry bag 30 over the flotation device such that the flotation device with the attached dry bag 30 is stable when being towed and when still on water. The instructions may be provided separately to the dry bag and flotation device, and/or provided on the flotation device and/or dry bag 30.

The float is arranged so that an inflatable base in the space between the side portions 10*b*, 10*c*, or an inflatable rear portion bridging the side portions 10*b*, 10*c*, does not need to be provided. This reduces the amount of material needed to manufacture the flotation device, enabling the flotation device to be lighter. Generally, the mass distribution is such that the inflated volume can be minimised or at least reduced.

In some embodiments, a base end of the bag may be located below water level in use. The displacement of the water results in uplift proportionate to the volume of the displaced water. This reduces the float that the flotation device has to provide to support the bag.

Figure 5:
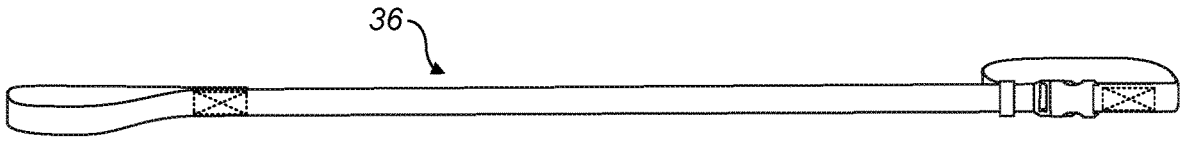
FIG. 5 is view of a tow leash.

The securing portion 26 comprises a D-ring 28. Referring to FIG. 5, a tow leash 36 is attachable to the D-ring 28 to allow the flotation device and the dry bag to be dragged by a swimmer. The tow leash can be attached with a carabiner (not shown), for example.

In use, items can be located in the dry bag and the dry bag sealed at the closure. The dry bag is then located on the flotation device with a base end of the dry bag located in or on a top portion of the U-shaped space and the bag resting against the lead portion 10*a*, such that the sealed end is on and/or above a top surface of the lead portion 10*a* with the marker 31 covered. The first, second and third straps 14*a-c* are then attached by the respective buckle over the dry bag and tightened. In particular, the third strap 13*c* is fixed such that the dry bag 30 is located to cover the marker 31. The flotation device with the dry bag 30 attached to it can then be located on water and a swimmer can then drag the flotation device and bag 30 with the tow leash 36.

Advantageously, the closure of the bag, where egress of water into the bag may occur, mostly stays above the water level in use. Also, since the dry bag does not break water as it is dragged, and due to the shape of the lead portion 10*a* of the float, the resistance to passage through the water is kept low.

Preferably the distance between the surfaces of the first and second side portions 10*b*, 10*c* in the U-shaped space is at least 25 cm and the dry bag has a width of at least 40 cm. In this case, items that are relatively large can be located in the dry bag 30. For example, a hiking rucksack, which may include a sleeping bag and a tent, may be located in the dry bag 30. The flotation device and the dry bag 30 may be carried in the rucksack prior to use. Advantageously, a user may use any rucksack and a water-proof rucksack is not required.

The mass of the flotation device, dry bag 30 and the tow leash is preferably less than 1.2 kgs, preferably less than 1.1 kg, preferably still less than 1 kg. An aim of the flotation device and the dry bag 30 is that, when the flotation device is deflated, both can be compressed and located in a rucksack for carrying when hiking. The same rucksack can then be located in the dry bag when open water is to be crossed.

The dry bag 30 has an opening with a flexible circumference of at least 50 cm, preferably at least 60 cm, and preferably less than 100 cm. Thus, the larger items mentioned above can be easily retained.

Advantageously, the flotation device provides sufficient float when inflated that it can be used with the dry bag containing items of at least 10 kgs and preferably at least 14 kgs. Such items may include, but are not limited to the rucksack, a tent, stove, clothes, food enabling multi-day trips which involve one-way swims over open water.

Whereas in the prior art an inflatable float is known that provides a space to retain items when in water, such a float only enables small items to be retained. In a rugged environment, particularly when it is wanted to transport relatively large items such as a rucksack through water, the dry bag being separate from the flotation device is advantageous since it is easier to handle such parts separately.

In a modified embodiment, the tow leash may be attached to the dry bag rather than to the float.

The applicant hereby discloses in isolation each individual feature or step described herein and any combination of two or more such features, to the extent that such features or steps or combinations of features and/or steps are capable of being carried out based on the present specification as a whole in the light of the common general knowledge of a person skilled in the art, irrespective of whether such features or steps or combinations of features and/or steps solve any problems disclosed herein, and without limitation to the scope of the claims.

I claim:

1. A kit for towing through water by a swimmer to transport items, comprising:

an inflatable flotation device comprising an inflatable lead portion, two inflatable spaced side portions and a dry bag connector, wherein the side portions each extend rearwardly from the lead portion; and a dry bag separate to the flotation device and having an openable, water-tight closure, wherein the side portions, when the device is inflated, and the dry bag are respectively shaped to cooperate so that the side portions provide support for the dry bag, wherein the dry bag connector is configured to attach the dry bag to the flotation device such that the closure is located above the lead portion of the flotation device, wherein the flotation device is arranged such that the dry bag connector can secure the dry bag against the flotation device on an upper portion thereof with the closure over the lead portion, wherein the kit is attachable to a tow leash such that a swimmer can tow the flotation device with the dry bag attached in water and such that the lead portion leads through the water, wherein the kit has mass of less than 1.2 kgs, wherein a volume that the dry bag is able to contain is at least 70 litres.

2. The kit of claim 1, wherein, when in use, an outer periphery of the flotation device tapers towards the lead portion in a plane parallel to water level.

3. The kit of claim 1, wherein the inflated side portions are spaced, the inflated lead portion is shaped and the dry bag connector is arranged such that the dry bag can be located on the flotation device to tilt downwardly into the space between the side portions.

4. The kit of claim 1, wherein the dry bag connector comprises a plurality of straps.

5. The kit of claim 4, wherein a respective length of one, some, or all of the straps of the plurality of straps is adjustable.

6. The kit of claim 4, wherein one or two straps of the plurality of straps are configured to extend between the side portions diagonally with respect to a length of the flotation device.

7. The kit of claim 4, wherein a first strap of the plurality of straps is configured to a extend along a length of the dry bag and is attached at one end thereof to the lead portion.

8. The kit of claim 1, wherein the flotation device has a marking on a top of the lead portion located to enable a user to locate a closure end of the dry bag over the marking when attaching the dry bag to the flotation device.

9. The kit of claim 7, wherein the flotation device has a marking on a top of the lead portion located to enable a user to locate a closure end of the dry bag over the marking when attaching the dry bag to the flotation device, and wherein the first strap of the plurality of straps is arranged to secure the dry bag on the flotation device to prevent movement of the dry bag with respect to the length of the flotation device.

10. The kit of claim 1, further comprising a non-inflatable member extending between the two side portions.

11. The kit of claim 10, wherein a first strap of a plurality of straps is configured to extend along a length of the dry bag and is attached at one end thereof to the lead portion, and wherein the other end of the first strap of the plurality of straps is attached to the non-inflatable member.

12. The kit of claim 1, further comprising the tow leash attached to the lead portion.

13. The kit of claim 1, wherein the closure of the dry bag opens to have a circumference of at least 60 cm.

14. The kit of claim 1, wherein the flotation device enables floating of items within the dry bag of at least 10 kgs.

15. An assembly comprising the kit claim 1, wherein the dry bag is attached to the inflated flotation device, with the tow leash attached to the flotation device.

16. A method comprising:

inflating a flotation device, the flotation device comprising a dry bag connector, an inflatable lead end and two inflatable, spaced side portions extending rearwardly from the lead portion, wherein the inflating the flotation device comprises inflating the lead end and the two spaced side portions;

locating at least one item in a dry bag having an openable, water-tight closure, the dry bag being separate to the flotation device, securing the dry bag against an upper portion of the side portions of the flotation device using the dry bag connector such that the closure is located over a lead portion thereof in use, wherein the kit has mass of less than 1.2 kgs, wherein a volume that the dry bag is able to contain is at least 70 litres, wherein the kit is attachable to a tow leash such that a swimmer can tow the flotation device with the dry bag attached in water.

17. The method of claim 16, wherein the attaching the dry bag comprises attaching the dry bag such that a closure end of the dry bag is located over a marking on the lead end, wherein the marking is located so that, when covered by the dry bag, the flotation device and the dry bag have improved stability on water.

18. The method of claim 16, wherein the flotation device further comprises a support member located between the side portions.

* * * * *